US005671925A

United States Patent [19]

Gonzalez

[11] Patent Number: 5,671,925

[45] Date of Patent: Sep. 30, 1997

[54] CIRCULAR GAMEPIECE WITH PROTECTOR

[75] Inventor: Mark A. Gonzalez, Plano, Tex.

[73] Assignee: MGwhiz, Inc., Plano, Tex.

[21] Appl. No.: 712,080

[22] Filed: Sep. 11, 1996

[51] Int. Cl.[6] ..... A63B 65/10

[52] U.S. Cl. ..... 273/424; 273/108.4; 273/126 R

[58] Field of Search ..... 273/317.1–317.9, 273/428, 424, 108.1, 108.2, 108.4, 108.5, 126 R, 128 R, 128 CS; 40/27.5, 323; 229/92.9

[56] References Cited

U.S. PATENT DOCUMENTS

| | | | |
|---|---|---|---|
| 1,085,405 | 1/1914 | Dadd | 434/345 |
| 1,735,456 | 11/1929 | Garman | 434/345 |
| 2,212,766 | 8/1940 | Andelenis | 273/424 |
| 3,100,642 | 8/1963 | Goldstein | 273/157 |
| 4,435,911 | 3/1984 | Jones | 40/27.5 |
| 4,733,867 | 3/1988 | Kemp et al. | 273/94 |
| 4,827,640 | 5/1989 | Jones | 40/27.5 |
| 5,110,127 | 5/1992 | Potter | 273/85 R |
| 5,186,461 | 2/1993 | Tucker | 273/94 |
| 5,257,783 | 11/1993 | Callaghan | 273/128 R |
| 5,351,968 | 10/1994 | Starnes | 273/424 |
| 5,406,264 | 4/1995 | Polonsky et al. | 40/27.5 |
| 5,465,976 | 11/1995 | Gonzalez | 273/353 |
| 5,501,468 | 3/1996 | Browne | 273/424 |

*Primary Examiner*—William M. Pierce

*Attorney, Agent, or Firm*—Fulbright & Jaworski L.L.P.

[57] ABSTRACT

A substantially planar circular gamepiece with a recess adapted to receive a weight. The weight is advantageously of sufficient mass so that when the weight is placed in the recess of the gamepiece, a finger flick applied to the outer perimeter of the gamepiece is likely to propel the gamepiece across a surface without the gamepiece flipping over. A substantially planar protector is also disclosed, with a hole provided to receive the gamepiece therein for storage when not in use. When the gamepiece is received into the protector, a substantially continuous common planar surface is formed, suitable for imposing collectable and tradeable images thereon by printing or other means.

18 Claims, 2 Drawing Sheets

FIG. 1
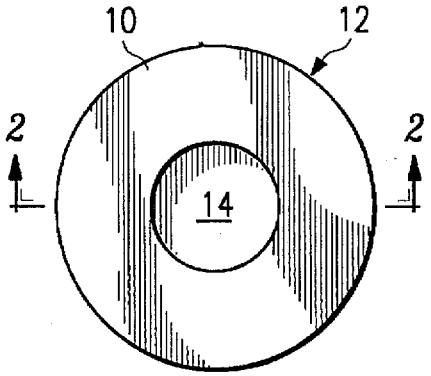
FIG. 1A
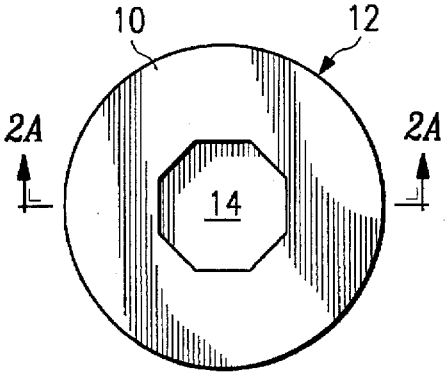
FIG. 2
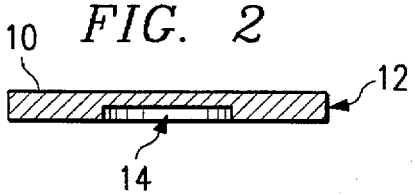
FIG. 2A
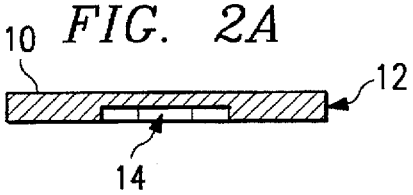
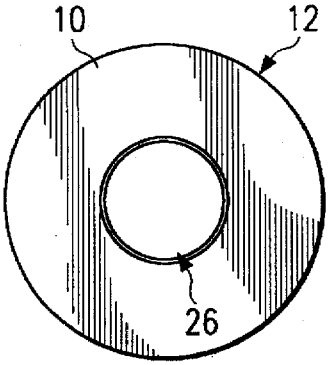
FIG. 3
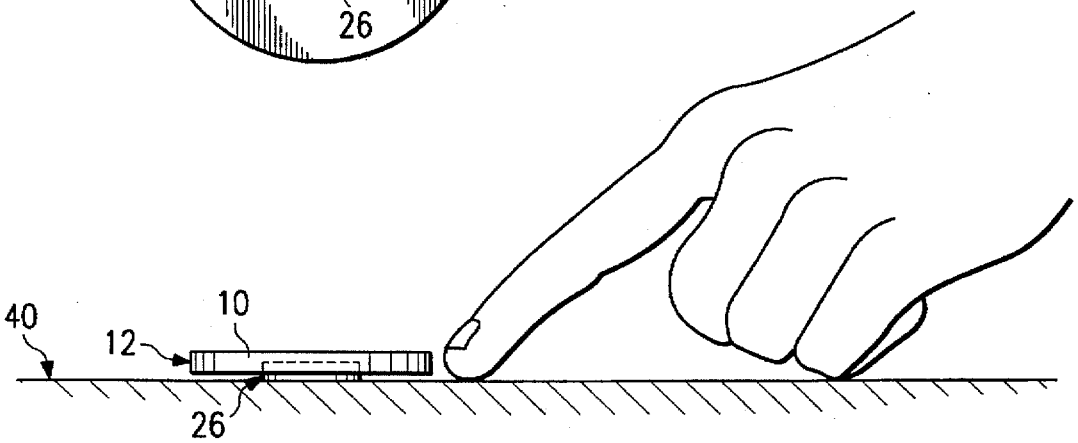
FIG. 4

CIRCULAR GAMEPIECE WITH PROTECTOR

BACKGROUND OF THE INVENTION

Adults and children alike have amused themselves for years by propelling puck-like gamepieces with finger flicks. Such gamepieces are commonly propelled across surfaces, such as table tops, with the objective of impacting other gamepieces, crossing designated boundaries or stopping in designated areas. As this recreational pastime has developed, games using the finger flick technique have emerged to simulate well-known sports such as soccer, hockey and others. Additionally, games have been developed which simulate activities in which multiple balls or objects interact such as pool, billiards and others.

Experience in propelling a planar gamepiece across a surface with a finger flick has shown that the gamepiece will tend to flip over if the gamepiece is not of sufficient weight. Also, the gamepiece may fail to slide a sufficient distance if it does not have sufficient momentum. Experimentation has revealed that a weighted gamepiece will slide farther and will also remain substantially in contact with the surface during the slide. The additional mass of the weighted gamepiece provides the gamepiece with greater momentum, resulting in longer sliding distances in response to finger flicks. The weighted gamepiece also tends to remain on the surface and will not flip over when a finger flick is applied.

Weighted gamepieces also enhance the interaction of multiple gamepieces. The increased mass of a weighted gamepiece provides greater momentum which can be transferred between gamepieces when the gamepieces collide. The motion created by a finger flick to one weighted gamepiece can be transferred to other gamepieces upon impact. This results in multiple gamepieces in motion and increases the skill of the game when the object is to score points by effecting controlled collisions of gamepieces.

The weight of the gamepiece could always be increased by constructing the gamepiece out of a heavier material. This solution would not be very satisfactory because the heavier material would be likely to increase the cost of manufacture of the gamepiece. A more effective solution would be to provide a lightweight gamepiece with a recess which is suitably adapted to receive a commonly available weight, such as a coin. Multiple gamepieces could then be collected and traded. Further, by insertion of weights such as coins into their recesses, the gamepieces would become ready for games of skill.

Accordingly, there is a need for a gamepiece that is capable of receiving a commonly available weight that will enhance the response of the gamepiece to a finger flick in games of skill sliding the gamepiece over a surface.

SUMMARY OF THE INVENTION

The present invention is therefore directed to a substantially planar gamepiece with a recess adapted to receive a weight. The recess can be formed in a variety of ways and may take the form of a hole extending through the gamepiece or an indentation which does not extend completely through the gamepiece.

The design of the recess may selected from many different shapes. The shape generally will be determined by the object to be inserted. Common objects such as coins, washers or other circular objects may be used and will require a generally cylindrical recess. Additionally, multi-sided coins or objects with polygonal shapes may be used and would require an appropriate polygonally shaped recess. Specially designed objects or collectable tokens may also be used as the weighted object. These would allow the gamepiece manufacturer to provide gamepieces which uniquely match specially designed weights.

The preferred embodiments disclosed herein are directed to a substantially circular gamepiece. Flicking this circular gamepiece is intended to simulate, for example, kicking a soccer ball, shooting a hockey puck or shooting a cue ball. It will be understood, however, that the present invention is not limited to circular-shaped gamepieces but may be enabled on a gamepiece of any shape where it is advantageous to provide additional weight.

The present invention also discloses a protector for the gamepiece. Clearly, it is important to minimize damage to the gamepiece in order to prolong its life. To this end, the preferred embodiment discloses a substantially planar protector providing a hole or recess of suitable perimeter for receiving the gamepiece and storing it when not in use.

When a substantially planar gamepiece is received into a substantially planar protector, the gamepiece combined with the protector advantageously provides a common planar surface. This common planar surface is suitable to be printed with collectable and tradeable images. Further, gamepieces as printed may be interchanged with various protectors bearing other printed images. As a result, gamepieces and protectors may be collected, interchanged and traded to bring added recreational value to the basic object of achieving levels of skill in flicking the gamepieces.

It is therefore an object of this invention to create a game of skill that requires the player to propel a gamepiece across a surface by means of a finger flick on the outer perimeter thereof.

It is a further object of this invention to provide a gamepiece of lightweight manufacture that is capable of receiving a commonly available weight, so that the gamepiece, with the weight received therein, will more easily slide across a surface and will remain substantially in contact with the surface during the slide.

It is a further object of this invention to protect the outer perimeter of the gamepiece when not in use by providing a protector with a void into which the gamepiece may be received and stored snugly.

It is a further object of this invention to create a game of skill that is easy and inexpensive to manufacture, and that may be played almost anywhere.

It is another object of this invention to provide the basis for a collectable and tradeable series of reproductions when the gamepiece is received into the protector. The preferred embodiment hereof provides a substantially continuous planar surface onto which a collectable and tradeable image can be fixed by printing or other means. The part-image on the gamepiece may then be separated from the part-image on the protector to allow multiple part-images to be interchanged, thereby adding a further dimension to the collectable and tradeable aspects of the present invention.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which:

FIG. 1 is an elevation view of a first embodiment of gamepiece 10, disclosing an outer perimeter 12 and a recess 14.

FIG. 1A is an elevation view of a second embodiment of gamepiece 10, disclosing an outer perimeter 12 and an alternatively shaped recess 14.

FIG. 2 is a sectional view through gamepiece 10 as shown on FIG. 1 or FIG. 1A.

FIG. 2A is a sectional view of a third embodiment of gamepiece 10 as shown on FIG. 1 or FIG. 1A.

FIG. 3 is an elevation view showing weight 26 in recess 14 of the first embodiment of gamepiece 10.

FIG. 4 is a perspective view showing the first embodiment of gamepiece 10 in use, at the moment of impact by a finger flick.

DESCRIPTION OF THE PREFERRED EMBODIMENTS

Figure 5:
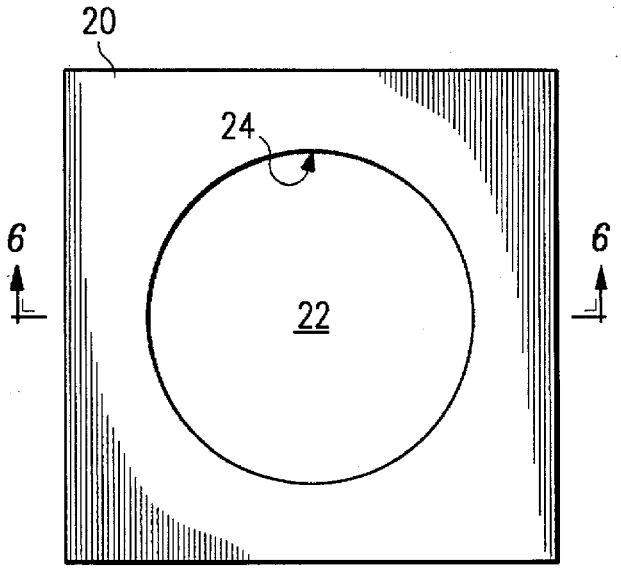
FIG. 5 is an elevation view of protector 20 adapted for use with the first embodiment herein, disclosing hole 22.

Referring to FIG. 1 and FIG. 2, gamepiece 10 is substantially planar and has an outer perimeter 12 of substantially circular shape. Gamepiece 10 also has a recess 14 therein. Referring to FIG. 1, a first embodiment of gamepiece 10 has a substantially circular shaped recess 14. In FIG. 1A, a second embodiment of gamepiece 10 has a polygonally shaped recess 14. As shown in FIG. 2, in a one embodiment, recess 14 extends partially through gamepiece 10. FIG. 2A shows another embodiment of gamepiece 10 in which recess 14 extends completely through gamepiece 10.

Referring to FIG. 3, recess 14 of gamepiece 10 receives weight 26 in a snug fit thereby operatively retaining weight 26. As shown in FIG. 4, gamepiece 10 is propelled across surface 40 by applying a finger flick to outer perimeter 12.

Figure 6:
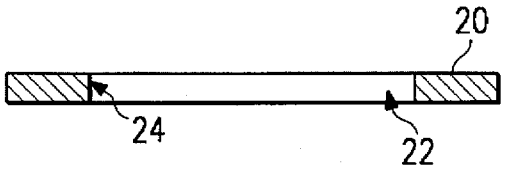
FIG. 6 is a sectional view through protector 20 as shown on FIG. 5.
Figure 7:
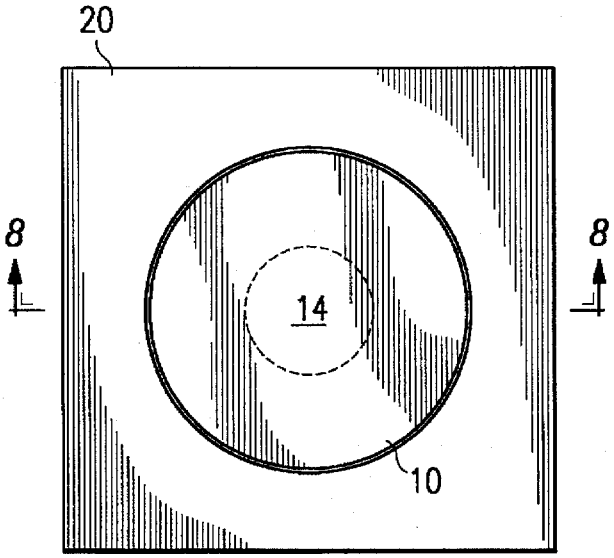
FIG. 7 is an elevation view showing first embodiment of gamepiece 10 received into protector 20 when not in use.

Referring now to FIG. 5 and FIG. 6, protector 20 is also substantially planar, and provides a substantially circular hole 22 therein. Hole 22 has an inner perimeter 24. As shown in FIG. 7, the size and shape of inner perimeter 24 is predetermined to match substantially the size and shape of outer perimeter 12 of gamepiece 10, so that gamepiece 10 fits snugly when received into hole 22.

Figure 8:
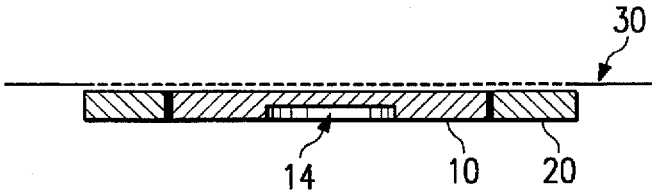
FIG. 8 is a sectional view as shown in FIG. 7.

Referring to FIG. 8, it will be seen that when gamepiece 10 is received into protector 20, a substantially continuous common planar surface 30 is provided, suitable for receiving collectable and tradeable images by printing or other means.

Although the foregoing preferred embodiment discloses a substantially circular gamepiece having a substantially circular recess protected by a substantially planar protector with a hole therethrough, it will be understood that the present invention is not limited to such constraints of shape. It will be understood that the present invention may be embodied on gamepieces of any shape. Further it will be understood that the recess in the gamepiece may be embodied in any three-dimensional shape. Additionally, the protector could be of any three-dimensional shape with a void therein to receive and protect the gamepiece. Moreover, instead of being a hole, the void in the protector could also be a recess extending only partially through the protector.

Although the present invention and its advantages have been described in detail, it should be understood that various changes, substitutions and alterations can be made herein without departing from the spirit and scope of the invention as defined by the appended claims.

I claim:

1. A gamepiece, comprising:

a substantially planar gamepiece having first and second faces, the gamepiece also having an outer perimeter, the outer perimeter being of a predetermined shape;

the gamepiece also having a recess in one of the faces, the recess being of a predetermined shape, the recess disposed to receive a weight;

the weight, when received in the recess, operable to stand proud of said recessed face;

the weight further operable to cause the gamepiece, when laid on a substantially smooth surface with said recessed face lying posteriorly, to respond to a blow struck to the outer perimeter thereof by staying close to said surface while sliding on said surface.

2. The gamepiece of claim 1, wherein the outer perimeter is of a substantially circular shape.

3. The gamepiece of claim 1, wherein the recess is of substantially circular shape.

4. The gamepiece of claim 1, wherein the recess is of a polygonal shape.

5. The gamepiece of claim 1, wherein the weight is a coin.

6. The gamepiece of claim 1, wherein the weight is a collectable token.

7. The gamepiece of claim 1, further comprising:

a solid protector of predetermined shape, the solid protector having a void therein, the void having an inner perimeter, the inner perimeter substantially matching the size and shape of the outer perimeter of the gamepiece;

the solid protector and the gamepiece further having indicia, wherein said indicia combine to communicate information.

8. The gamepiece of claim 7, further comprising: a substantially continuous common planar surface formed across the gamepiece and the protector when the gamepiece is received into the void.

9. The gamepiece of claim 7, wherein the shapes of the outer perimeter of the gamepiece and of the inner perimeter of the void are substantially circular.

10. The gamepiece of claim 7, wherein the solid protector is substantially planar in shape.

11. The gamepiece of claim 7, wherein the void is a hole through the solid protector.

12. The gamepiece of claim 7, wherein the void is a recess extending only partially through the solid protector.

13. A gamepiece, comprising:

a substantially planar gamepiece having first and second faces, the gamepiece also having an outer perimeter, the outer perimeter being of substantially circular shape;

the gamepiece also having a recess of substantially circular shape in one of the faces, the recess disposed to receive a weight;

the weight, when received in the recess, operable to stand proud of said recessed face;

the weight further operable to cause the gamepiece, when laid on a substantially smooth surface with said recessed face lying posteriorly, to respond to a blow struck to the outer perimeter thereof by staying close to said surface while sliding on said surface.

14. The gamepiece of claim 13, wherein the weight is a coin.

15. The gamepiece of claim 13, wherein the weight is a collectable token.

16. The gamepiece of claim 13, further comprising:

a substantially planar protector, the protector providing a void, the void having an inner perimeter, the size and shape of the inner perimeter substantially matching the size and shape of the outer perimeter of the gamepiece;

the solid protector and the gamepiece further having indicia, wherein said indicia combine to communicate information.

17. The gamepiece of claim 16, further comprising:

a substantially continuous common planar surface formed across the gamepiece and the protector when the gamepiece is received into the hole.

18. A gamepiece, comprising:

a substantially planar gamepiece having first and second faces, the gamepiece also having an outer perimeter, the outer perimeter being of substantially circular shape;

the gamepiece also having a recess of substantially circular shape in one of the faces, the recess disposed to receive a weight;

the weight, when received in the recess, operable to stand proud of said recessed face;

the weight further operable to cause the gamepiece, when laid on a substantially smooth surface with said recessed face lying posteriorly, to respond to a blow struck to the outer perimeter thereof by staying close to said surface while sliding on said surface; and a substantially planar protector, the protector providing a void, the void having an inner perimeter, the size and shape of the inner perimeter substantially matching the size and shape of the outer perimeter of the gamepiece, wherein a substantially continuous common planar surface is formed across the gamepiece and the protector when the gamepiece is received into the void;

the solid protector and the gamepiece further having indicia, wherein said indicia combine to communicate information.

* * * * *